US007410813B1

(12) United States Patent
Gao

(10) Patent No.: US 7,410,813 B1
(45) Date of Patent: Aug. 12, 2008

(54) METHOD OF PARALLEL LAPPING A SEMICONDUCTOR DIE

(75) Inventor: Gengying Gao, Fremont, CA (US)

(73) Assignee: National Semiconductor Corporation, Santa Clara, CA (US)

( * ) Notice: Subject to any disclaimer, the term of this patent is extended or adjusted under 35 U.S.C. 154(b) by 268 days.

(21) Appl. No.: 10/948,857

(22) Filed: Sep. 23, 2004

(51) Int. Cl.
*H01L 21/00* (2006.01)

(52) U.S. Cl. ..... 438/4; 438/455; 438/459; 438/977; 257/E21.001

(58) Field of Classification Search ..... 438/458, 438/459, 465, 977, 4; 257/E23.135, E21.001
See application file for complete search history.

(56) References Cited

U.S. PATENT DOCUMENTS 5,655,948 A * 8/1997 Yapel et al. ..... 451/28
5,664,987 A * 9/1997 Renteln ..... 451/21
5,972,798 A * 10/1999 Jang et al. ..... 438/717
6,110,806 A * 8/2000 Pogge ..... 438/458
6,248,001 B1 * 6/2001 Carson et al. ..... 451/41
6,461,941 B2 * 10/2002 Kim ..... 438/462
6,661,102 B1 * 12/2003 Newman et al. ..... 257/787
6,683,379 B2 * 1/2004 Haji et al. ..... 257/729

FOREIGN PATENT DOCUMENTS

WO WO 96/39275 * 12/1996

* cited by examiner

*Primary Examiner*—Michael S. Lebentritt
*Assistant Examiner*—Angel Roman
(74) *Attorney, Agent, or Firm*—Jurgen Vollrath

(57) ABSTRACT

In a lapping process for lapping away layers from a semiconductor device, where the region of interest is located near an edge or corner of the device, the method includes adding additional semiconductor material adjacent the region of interest.

12 Claims, 2 Drawing Sheets

METHOD OF PARALLEL LAPPING A SEMICONDUCTOR DIE

FIELD OF THE INVENTION

The invention relates to fault analysis of defective semiconductor devices. In particular it relates to parallel lapping of a semiconductor die.

BACKGROUND OF THE INVENTION

Whenever a defect occurs in a semiconductor device it is desirable to be able to locate the source of the problem, thereby allowing the problem to be addressed. Numerous techniques have therefore been developed for locating defects in a die in the x-y plane as shown in FIG. 1. In particular scanning techniques such as e-beam (electron beam) and o-beam (laser beam) scanning has been developed to locate the source of a defect. However, this leaves questions as to the depth (z-axis) at which the defect identified in the x-y plane, is located. One solution to this problem is the gradual grinding or lapping away of layers of the semiconductor die. This involves a device such as the one shown in FIG. 2 which comprises a lapping wheel 200. The die 202 to be analyzed is attached to a fixture (sample holder) 204, which comprises a steel supporting plate. Typically the die 202 is attached to the sample holder 204 by means of wax, and the sample holder 204 is in turn connected to an oscillating head 206. During the lapping process the head 206 is lowered so that the die 202 engages the wheel 200. The wheel 200 has an abrasive surface 210 and rotates about a vertical axis 212. As the wheel 200 rotates, the head 206 oscillates back and forth to move the die laterally back and forth between the central axis 212 and the periphery 214 of the wheel. One problem with the lapping device is that it tends to lap or grind away the die more quickly along the outer edge 216 of the die and especially the corners of the die due to the greater speed of the lapping wheel 200 towards its periphery 204 as will be discussed in greater detail below. FIGS. 3 and 4 show a typical die 202 secured to a sample holder 204 and show how the profile of the die 202 changes in the course of lapping. FIG. 3 shows the profile before lapping and FIG. 4 shows the profile after lapping. It will be appreciated from the profile in FIG. 4 that if the defect is located along the outer edge 216 it becomes difficult to control the lapping to avoid lapping away all or portion of the defective region. The present invention seeks to provide a way of improving the lapping profile in the edge and corner regions of a semiconductor die.

SUMMARY OF THE INVENTION

According to the invention there is provided a method of lapping a semiconductor die if the region of interest is located near an edge or corner of the die, comprising securing additional semiconductor material adjacent the region of interest. Preferably the semiconductor material placed adjacent the region of interest is of the same material as the die itself and are preferably obtained from the same wafer as the die. The additional semiconductor material may be secured to the die, for example, by means of an adhesive such as a heat curable resin. Instead the additional semiconductor material may be secured to a common surface as the die such as a sample holder. In the latter situation, the additional semiconductor material may abut the die. The additional semiconductor material may consist of one or more pieces of semiconductor material. Preferably the size and location of the additional piece or pieces of semiconductor material is chosen so that the region of interest is located nearer the center of the combined semiconductor material of the die and additional semiconductor material. Thus, the size of the additional semiconductor material may be chosen so that it extends outward from the region of interest by a distance that is at least half the width of the die and may be equal to the width of the die. Where the region of interest is near a corner of the die, the additional semiconductor material may for instance comprise a half die and a quarter die from the same wafer, that are placed around said corner.

DETAILED DESCRIPTION OF THE INVENTION

Figure 1:
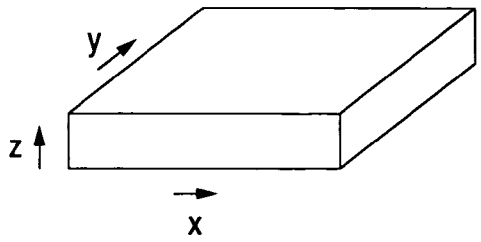
FIG. 1 (PRIOR ART)
FIG. 1 is a three dimensional representation of a semiconductor die.
Figure 2:
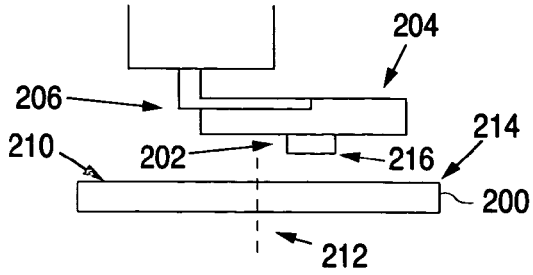
FIG. 2 (PRIOR ART)
FIG. 2 is a simplified representation of a lapping system known in the art.
Figure 3:
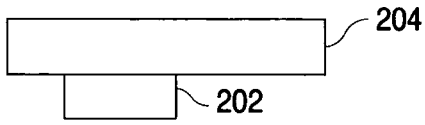
FIG. 3 (PRIOR ART)
FIG. 3 shows a side profile of a semiconductor die prior to lapping as known in the art.
Figure 4:
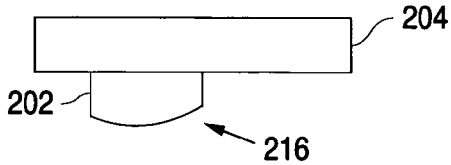
FIG. 4 (PRIOR ART)
FIG. 4 shows a typical side profile of a semiconductor die after lapping on a lapping system, as known in the art.
Figure 5:
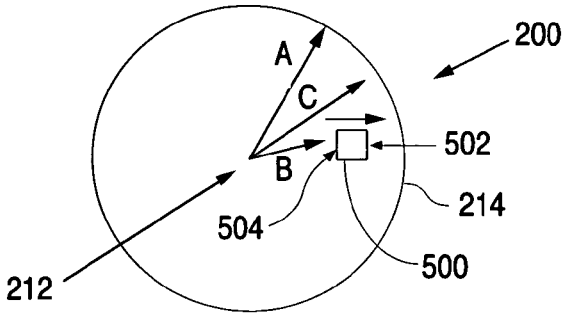
FIG. 5 (PRIOR ART)
FIG. 5 is a representation of a lapping wheel as seen from the top, FIG. 6 representation of the operation of a lapping system, as known in the art.

FIG. 5 represents a lapping wheel such as the wheel 200 of FIG. 2. The wheel 200 rotates about a central axis 212 and has a radius A. It will be appreciated that the circumference at radial distance B is shorter than at radial distance C thus causing the wheel 200 to rotate more quickly at a radial distance C from the axis 212 than at a radial distance B. This has a tendency to cause a die 500 that is moved between the central axis 212 and periphery 214 to be lapped away more rapidly along its outer edge 502 than along its inner edge 504.

Figure 6:
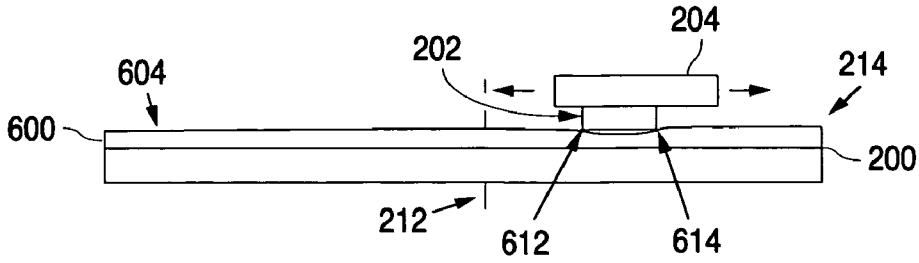
FIG. 6 (PRIOR ART)

Furthermore, the wheel 200 typically includes an upper layer made of a flexible compound, e.g., rubber with an abrasive upper surface for lapping or grinding away the die. The effect is shown in exaggerated fashion in FIG. 6 which shows a side view of a lapping wheel 200 having rubber layer 600 with grinding surface 604. As the die 202 is pressed down on the wheel 200 by the sample holder 204, the die 202 forms a slight indentation in the surface layer 600 of the wheel 200. It will be appreciated that this increases the grinding action along the edges 612, 614 of the die. Coupled with the greater speed of the wheel 200 along the outside of the die due to the greater circumference at the greater radial distance as discussed above with respect to FIG. 5, the outer edge 614 is particularly exposed to excessive lapping.

Where the region of interest is located at or near the edge of the die, especially the outer edge, the excessive lapping makes it difficult to control the removal of semiconductor material in these regions for purposes of analysis. Excessive lapping therefore often results in destruction of the very portion of the die that is of interest.

Figure 7:
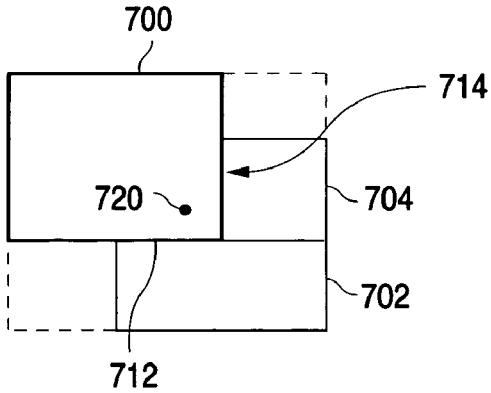
FIG. 7 shows a plan view of a semiconductor die with additional semiconductor material provided adjacent the die in accordance with one embodiment of the invention.
Figure 8:
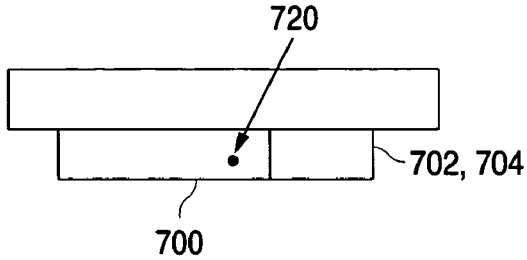
FIG. 8 shows the die and additional material of FIG. 7 in side view.

The present invention therefore proposes adding additional pieces of semiconductor material adjacent the edge of the die in situations where the region of interest, i.e., the defect region has previously been pinpointed in the x-y plane as being located at or near the edge of the die. This is illustrated in FIGS. 7 and 8, which show a plan view and a side view, respectively, of a die 700 with additional semiconductor pieces 702, 704 arranged adjacent the edges 712, 714 where the defective region to be analyzed (region 720) is located. Preferably the additional material pieces 702, 704 are made of the same or substantially the same material as the die 700. In particular, in one embodiment, the additional pieces of semiconductor material were from the same wafer as the die being analyzed. It will be appreciated that even if the pieces come from the same die, they may include minor differences in doping or metal layer etching, but will be considered as substantially the same material as the die, for purposes of this application. Even if the pieces come from another wafer, it will be appreciated that wafers can be chosen having substantially the similar or substantially the same physical characteristics as the die being analyzed, since other pieces from the same wafer may not be available e.g. when a single die is rejected by a customer. In one embodiment the pieces 702, 704 were secured to the die 700 by means of an adhesive. In one particular embodiment an epoxy bond (Epoxy Bond 110) produced by Allied High Tech Products, Inc. of Rancho Dominguez, Calif. was used which was then heated by heating the semiconductor pieces 700, 702, 704 to 150 degrees Centrigrade for 5 minutes to secure the pieces 702, 704 to the die 700.

In the embodiment shown, the piece 702 comprised half a rejected die from the same wafer, while piece 704 comprised a quarter of a rejected dir from the same wafer. Making use of simple shapes as those shown for pieces 702 and 704 make it easy to either cut or break an existing rejected die while providing dimensions that would cause the defect 720 to be located nearer the middle of the newly defined semiconductor structure as defined by the die 700 and pieces 702, 704. It will be appreciated that if the defect to be analyzed is located not at a corner as in FIG. 7 but along an edge, it may only me necessary to add a single additional piece of semiconductor material. The intent is to place the region of interest or defect region, i.e., the region to be analyzed nearer the center of the combined semiconductor structure. Thus, it will be appreciated that the additional semiconductor piece or pieces will be chosen depending on where the defect region is located on the die. It will be appreciated that the pieces 702, 704 in FIG. 7 do not place the region of interest 720 exactly in the center of the combined semiconductor structure and that it is possible to use larger pieces of additional semiconductor material to place the region of interest 720 closer to the center of the combined structure. In each case the location of the region or area of interest in the die will be taken into account in determining the size, location and number of additional pieces of semiconductor material to be placed adjacent the die. However ease of cutting or breaking off additional semiconductor pieces from rejected die of the same wafer and availability of such additional material may make it desirable to use simple structures as shown in FIG. 7. Also, since lapping speed will slow down if too much additional material is added, a further consideration is avoiding adding unnecessary additional semiconductor material.

It will also be noted that in the embodiment of FIG. 7, no attempt was made to fill in the regions depicted by reference numerals 720, 722. Not only is it easier and less labor intensive to leave these regions open, it also avoids unnecessary material being added that would unnecessarily slow down the lapping process.

Figure 9:
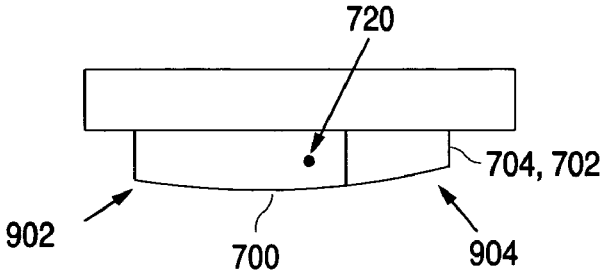
FIG. 9 shows a typical side profile of the structure of FIG. 8 after lapping on a lapping wheel.

While the embodiment discussed above secured the additional semiconductor pieces to the die 700 under test, another embodiment involved simply attaching the die and additional semiconductor pieces to the sample holder of the lapping system by means of wax. In fact it was found that excessive lapping along the edges of the die due to the flexing of the lapping wheel surface could be avoided even if the die and additional semiconductor pieces were not actually abutting each other. The additional semiconductor pieces nevertheless redistributed the force exerted by the wheel on the die, thereby avoiding the excessive bowing effect of the wheel surface at the edge of the die. FIG. 8 shows the die 700 and additional pieces 702, 704 as viewed from the side. This more clearly demonstrates the effect of shifting of the region of interest 720 toward the center of the combined semiconductor structure. The effect of the additional pieces 702, 704 on the lapping process is shown in FIG. 9 which shows excessive lapping along the edges 902, 904, especially the outer edge 904 of the combined device. However, since the region of interest 720 is now located near the center of the combined structure, the excessive lapping effect does not impact the region 720.

While specific embodiments were discussed above, it will be appreciated that the invention will apply equally to other configurations of the added semiconductor material and in conjunction with other lapping devices that cause uneven lapping of dies.

What is claimed is:

1. A method of performing fault analysis in a semiconductor die comprising,

Locating a defect in an x-y plane of the semiconductor die, securing one or more pieces of additional semiconductor material adjacent the defect, wherein the size and location of the one or more pieces of additional semiconductor material are chosen so that the defect is located substantially near the center of the combined surface area of the semiconductor material of the die and the one or more pieces of additional semiconductor material, and lapping the semiconductor die to remove die material in a z-direction for analysis of the defect.

2. A method of claim 1, wherein the one or more pieces of additional semiconductor material are made of substantially the same material as the die itself.

3. A method of claim 2, wherein the one or more pieces of additional semiconductor material are obtained from the same wafer as the die.

4. A method of claim 3, wherein if the defect is near a corner of the die, the one or more pieces of additional semiconductor material comprise a half die and a quarter die piece from the same or similar wafer as the die.

5. A method of claim 4, wherein the additional pieces of semiconductor material are placed around said corner.

6. A method of claim 1, wherein the one or more pieces of additional semiconductor material are secured to the die.

7. A method of claim 6, wherein the one or more pieces of additional semiconductor material are secured to the die by means of an adhesive.

8. A method of claim 7, wherein the adhesive is a heat curable resin.

9. A method of claim 1, wherein the one or more pieces of additional semiconductor material are secured to a common surface as the die.

10. A method of claim 9, wherein the common surface is a sample holder.

11. A method of claim 1, wherein the one or more pieces of additional semiconductor material abut the die.

12. A method of claim 1, wherein the location of the additional semiconductor material is chosen to avoid surrounding the semiconductor die on all sides with the additional semiconductor material.

* * * * *